United States Patent [19]

Schafer et al.

[11] Patent Number: 5,038,993

[45] Date of Patent: Aug. 13, 1991

[54] NAIL DRIVING DEVICE

[75] Inventors: Manfred Schafer, Bad Homburg; Siegmund Oberhofer, Pforzheim; Horst Tacke, Bad Vilbel, all of Fed. Rep. of Germany

[73] Assignee: ITW BEFESTIGUNGSSYSTEME GmbH, Eschborn OT Niederhochstadt, Fed. Rep. of Germany

[21] Appl. No.: 462,200

[22] Filed: Jan. 9, 1990

[30] Foreign Application Priority Data

Jan. 14, 1989 [DE] Fed. Rep. of Germany ..... 3901043

[51] Int. Cl.[5] ..... B25C 1/04

[52] U.S. Cl. ..... 227/120; 227/103

[58] Field of Search ..... 227/99, 103, 109, 120

[56] References Cited

U.S. PATENT DOCUMENTS

| | | | |
|---|---|---|---|
| 3,238,983 | 3/1966 | Abrahamsen | 227/120 X |
| 3,437,249 | 4/1969 | Baum | 227/120 |
| 3,980,179 | 9/1976 | Schrepferman | 227/120 X |
| 4,136,810 | 1/1979 | Bull | 227/120 |
| 4,558,811 | 12/1985 | Klaus | 227/120 X |
| 4,784,306 | 11/1988 | Baum | 227/120 X |

*Primary Examiner*—Paul A. Bell

*Attorney, Agent, or Firm*—Schwartz & Weinrieb

[57] ABSTRACT

The present invention comprises a nail driving device with a magazine for nails held together in nail strips, with a nail transport device, wherein the nail strips are pressed in the direction of a fixed stop surface by means of a spring element, and moved in the direction of the exit channel of the device mouthpiece. In order to be able to work with nail strips in which the nail shafts are spaced apart, but rather lie shaft against shaft, it is provided that the nail transport device has a transport shuttle which can be moved in the longitudinal direction of the magazine using the piston rod of the feed cylinder, and which has a wedge-shaped nail strip separating element which is operative during the reverse movement of the shuttle such that the transport element is formed as an advance clamp which grasps the separated nail strip laterally during the forward movement of the transport shuttle in such a way that the nail strip resting against the stop surface can be clamped between the transport shuttle and the advance clamp by means of spring action, and can therefore be moved forwardly along with the transport shuttle.

20 Claims, 3 Drawing Sheets

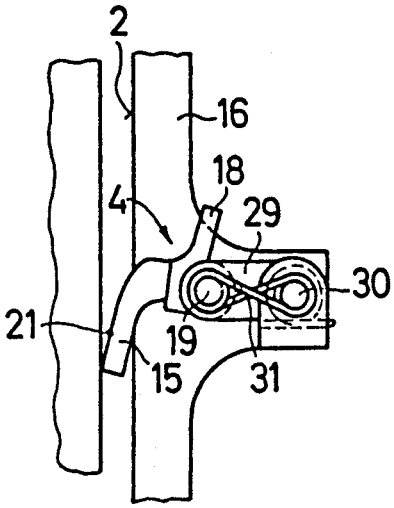
FIG. 1b
FIG. 1a
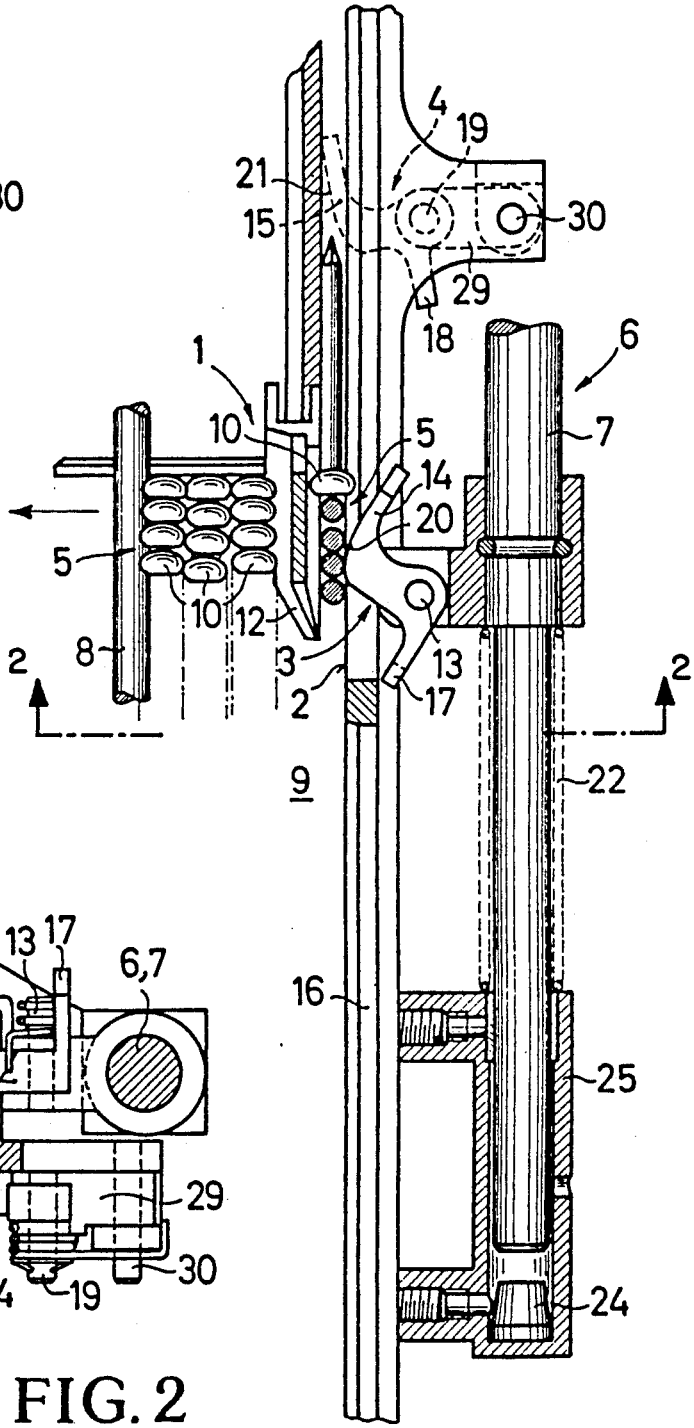
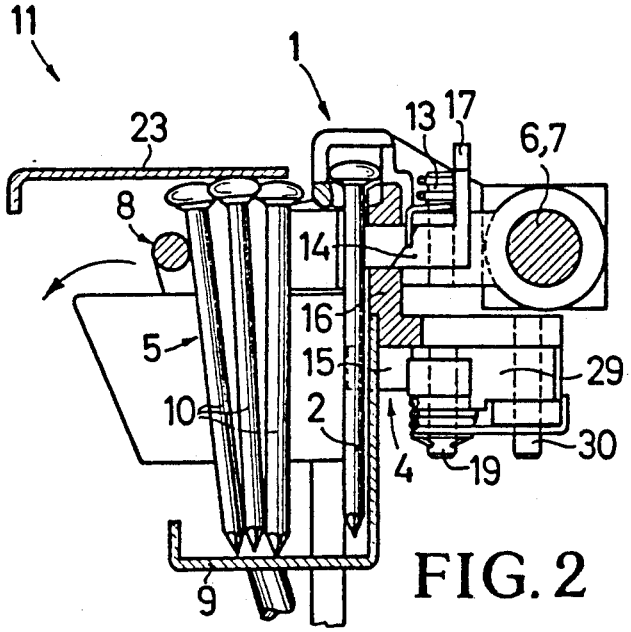
FIG. 2

NAIL DRIVING DEVICE

FIELD OF THE INVENTION

The present invention relates to a nail driving device which includes a magazine for nails held together in the form of nail strips, and which further includes a nail transport device connected to the magazine, which feeds the nails, one after another, from the front end of a guide which ends at an exit channel of the device mouthpiece by means of a lateral entry slit, into a position of readiness for being driven, such as, for example, pneumatically, out of the exit channel, with the magazine being formed as a box magazine for holding one or more nail strips next to one another, wherein the nail strips can be disposed, one after another, essentially vertically, with the planes of the nail strips disposed in alignment with the entry slit of the exit channel, by having the nail strips biased in the direction of a fixed stop surface which forms at least part of the guide, by means of at least one spring element, wherein the nail strip resting against the stop surface at any particular time can be transported in the direction of the exit channel by means of at least one transport element connected with a feed cylinder that can be activated pneumatically and/or by spring action, arranged adjacent to the stop surface.

BACKGROUND OF THE INVENTION

A device similar to that described above is known from EP 0 119 542. The nail driving device described therein has a magazine intended to hold several nail strips, and is provided with a nail transport device. The transport process is brought about by means of a feed latch attached to a feed cylinder, which is interposed between the individual nails of a nail strip and feeds the row of nails in the direction of the exit channel. A disadvantage with this type of device is that it can reliably operate only with nail strips whose nails are disposed with predetermined distance between one another, so that the feed latch can be disposed within the space between the nails. Therefore it is not possible to use this device when processing nails which are arranged in a closely spaced shaft to shaft manner within the nail strip so as to save space.

OBJECT OF THE INVENTION

It is the object of the present invention to create a nail driving device of the type mentioned initially, which can also reliably operate with nail strips in which the nails are not arranged with a gap defined therebetween, but to the contrary, are arranged in a shaft to shaft manner. This makes it possible to significantly increase the loading capacity of the maganzine, while maintaining the same exterior dimensions.

SUMMARY OF THE INVENTION

The foregoing and other objects are achieved according to the invention, by the provision of a nail transport device which has a transport shuttle, which can be moved in the longitudinal direction of the magazine by means of a piston rod of a feed cylinder, and which has a nail strip separating element, which is preferably wedge-shaped and which is operative during the reverse movement, such that the transport element is formed as an advance clamp which grasps the separated nail strip laterally during the forward movement of the transport shuttle, in such a way that the nail strip resting against the stop surface at any particular time can be clamped between the transport shuttle and the advance clamp by means of spring action, and can therefore be moved forwardly along with the transport shuttle.

In order to guarantee reliable operation of the nail transport device, a further development of the invention provides for a retainer device for the separated nail strip, which is operative during the reverse movement of the transport shuttle.

In accordance with a further form of the invention, one of the nail strips is lifted, relative to the remaining nail strips, by means of the nail strip separating element, during the reverse movement of the transport shuttle, which reliably prevents the nail heads of the separated nail strip from engaging or interfering with the nail heads of the adjacent nail strip.

In order to be able to effectively grasp the shanks of the nails at positions below the nail heads of the nail strip to be separated, the nail strip separating element of the transport shuttle moves in between the nail strips during its reverse movement.

In order to guarantee particularly reliable operation of the nail transport device, an additional development of the invention furthermore provides that the transport element advance clamp is attached to the transport shuttle in such a way that the clamping force upon the nail strip between the transport shuttle and the advance clamp becomes stronger as the transport shuttle moves forwardly, but is released when it moves backwardly.

This can be achieved in a particularly simple manner, in terms of design, by having the axis of rotation of the advance clamp disposed behind the clamping point of the advance clamp with respect to the row of nails.

Rapid and reliable clamping of the nail strip between the advance clamp and the transport shuttle can be guaranteed by constantly biasing the advance clamp against the stop surface of the nail strip by means of spring tension.

A further feature of the invention provides that the retainer device has a retainer claw which is formed so that it can be tilted backwardly by means of spring action when the nail strip is advanced.

In accordance with version of the invention, the axis of rotation of the retainer device is also disposed behind the clamping point of the retainer claw and the nail strip, which guarantees a reliable clamping effect during the reverse movement of the transport shuttle along with the advance clamp.

In order to allow the nail strip, which is clamped by means of the retainer device, and moves backwardly during the driving process of a D-head nail, to move out of the way briefly, an advantageous version of the invention provides that the retainer device is attached to a spring-action bracket.

In order to assure sufficient nail advancement under all working conditions, a further variant of the invention provides that the possible path of movement of the transport shuttle is many times that of the nail diameter.

The magazine is particularly easy to fill if the nails are guided so that they rest against a bottom, which is adjustable in height, of the magazine, with their points directed downwardly. This also makes it possible to accommodate nails of different lengths.

In accordance with a further development of the invention, the guide strip of the mobile transport shuttle also serves as the stop surface and rear wall of the magazine.

An additional version of the invention provides for handle pieces to be disposed at the transport element and at the retainer device, by means of which jamming of the separated nail strips in case of an incorrect operation can be easily eliminated.

The feed cylinder can be structured either as a dual-action cylinder or as a single-action cylinder with spring-action return, and can therefore be adapted to various design requirements.

It is particularly effective and cost-effective if the feed cylinder is supplied with air from the nail driving device itself.

In order to preclude malfunctions when the front nail is being driven, the separated nail strip can be maintained under pressure by means of the feed cylinder or the return spring during the nail driving process.

The magazine is particularly easy to fill, and reliable feeding of the nail strips against the stop surface can be assured if the spring element is formed as a spring-loaded stirrup which can extend over the entire length of the magazine.

In accordance with another advantageous embodiment of the invention, the spring element is mounted within the device so that it can be released and tilted upwardly, which allows easy one-hand loading of the magazine.

In order to guarantee even better accessibility and ease of operation of the magazine, the spring element can be arranged so as to be tilted away together with the top cover of the magazine.

In order to accommodate nails of different shaft lengths safely and without malfunctions, the bottom of the magazine is attached so that it is adjustable in height, in accordance with a further development of the invention.

An advantageous grasping point at a longitudinal or axially central portion of the nail shaft is obtained, with a compact construction, if the advance clamp and/or the retainer device grasp or grasps the nail shaft through means of a longitudinal slit defined within the guide strip.

In accordance with another embodiment of the invention, an ascending curve or ramp for lifting the separated nail strip is provided at the guide strip, which even more reliably prevents hooking or enmeshing of the nail heads.

In order to be able to simply and easily remove any nails, which might have jammed, from the entry slit, the invention is advantageously equipped with a quick-release mechanism.

In accordance with another variant of the invention, the nails are retained within the entry slit by means of a pressure spring, so that they cannot unintentionally enter the exit channel.

It is advantageous for assured movement of the nails if the nail heads are guided upon a guide edge of the guide strip.

BRIEF DESCRIPTION OF THE DRAWINGS

Further goals, advantages and possibilities of application of the present invention will become evident from the following description of the embodiments of the invention, when considered in connection with the accompanying drawings, in which like reference characters designate like or corresponding parts throughout the several views, and wherein:

FIG. 1*a* is a partial top view of the magazine of the nail driving device shown with the nail transport device of the present invention FIG. 1*b* is a partial view of the retainer device shown from below, FIG. 2 is a cross-section of the magazine showing the nail transport device taken along line 2—2 in FIG. 1, FIG. 3*a–d* are schematically, in side views, illustrations of the nail transport device with the magazine in four different phases of the nail strip transport as the same is moved from right to left, wherein

DETAILED DESCRIPTION OF THE ILLUSTRATED EMBODIMENTS

Figure 3C:
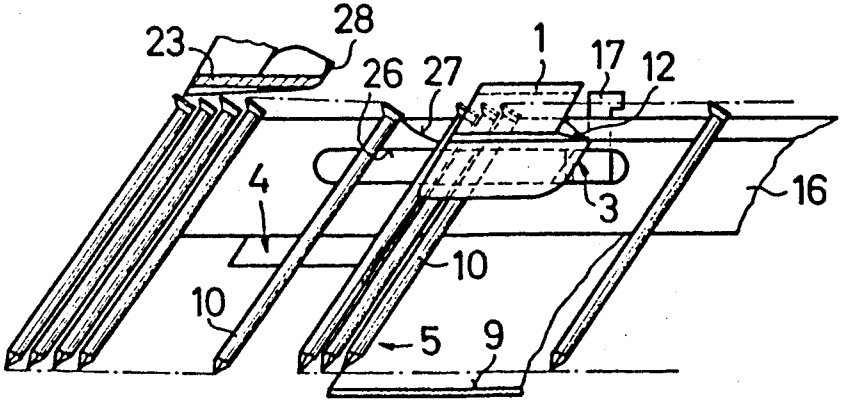
FIG. 3*c* illustrates a second nail strip being grasped.
Figure 3D:
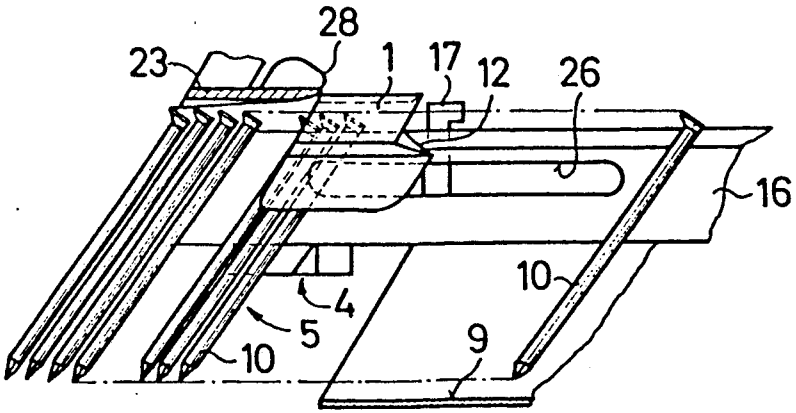
FIG. 3*d* illustrates the advancement of the second nail strip.
Figure 3A:
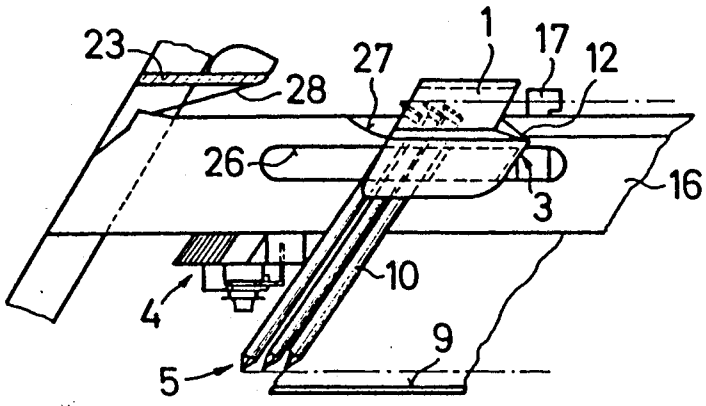
FIG. 3*a* illustrates a first nail strip being grasped.
Figure 3B:
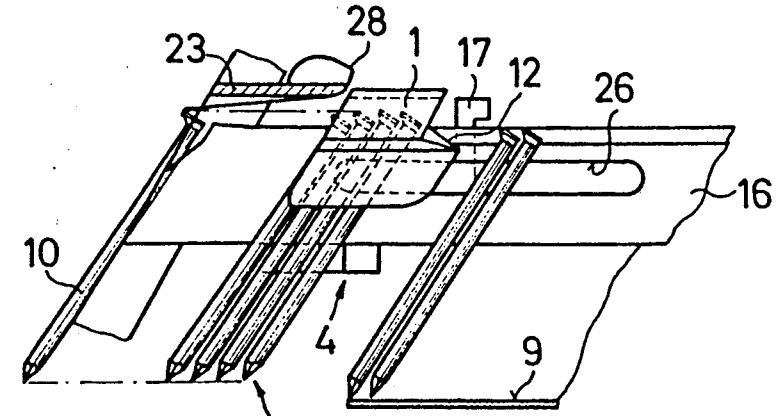
FIG. 3*b* illustrates the end of the transportation of a first nail strip.

The nail transport device of the present invention has a transport shuttle 1 which is guided upon a guide strip 16 along a magazine 11 which houses nail strips 5 with nails 10 lying shaft against shaft, and acts together with a transport element 3 formed as an advance clamp, as shown in FIG. 1*a*. Using the nail transport device, a nail strip 5 is adapted to be transported in the direction of an exit channel defined within the device mouthpiece, that is towards the top in FIG. 1*a*, so that the front nail 10 in each case is available for being driven, within the exit channel. For this purpose, the transport shuttle 1 is firmly attached upon a piston rod 7 of a feed cylinder 6, so as to be movable in the longitudinal direction of the magazine, and which is formed as a wedge-shaped nail strip separating element 12 at its rear end, such that when the transport shuttle 1 moves backwardly (that is downwardly as seen in FIG. 1*a*), because of its asymmetrical wedge shape, the nail strip 5 pressed against the guide strip 16 equipped with a guide edge for the nail heads, or against the stop surface 2 of the magazine formed as a continuation of the guide strip, by means of a stirrup formed as a spring element 8, along with the other nail strips 5 within the magazine, is separated and lifted relative to the remaining nail strips 5 within the magazine. By means of this operation the transport shuttle 1 moves between the two last nail strips 5, as is evident from FIG. 1*a*. The advance clamp 3 is attached to the piston rod 7 so as to rotate or pivot about an axis of rotation 13 defined upon the connecting web of the transport shuttle 1, and consists of a lock claw 14 and a handle piece 17. The axis of rotation lies behind the clamping point 20 of the lock claw 14, which is pressed by means of spring-action against the side of the separated nail strip 5 which is to be transported. In this way, the clamping force defined between the transport shuttle 1 and the lock claw 14 is increased when these two elements are moved in the feed direction of the nail strip 5, which is towards the top of FIG. 1*a*.

Further forward in the feed direction there is provided a retainer device 4, which is attached by means of an axis of rotation 19 to a bracket 29, which in turn is adapted to rotate upon the guide strip 16, about an axis of rotation 30 under the influence of a spring 31, as is evident from FIG. 1*b*, with the retainer device 4 having both a retainer claw 15 as well as a handle piece 18. As was the case with the lock claw 14, the retainer claw 15 has a clamping point 21, which lies in front of the axis of rotation 19 in the feed direction, so that the retainer claw 15, which is under spring tension, releases the nail strip 5 when the latter is moved forwardly, but locks the same if an attempt is made to move the nail strip 5 backwardly, and only moves backwardly a short distance, together with the spring-action bracket 29, during the driving process, when the head of the front nail 10 passes by the shaft end of the next nail which presses the same slightly backwardly when doing so.

The piston rod 7 of the single-action feed cylinder 6 is retracted back into the feed cylinder 6 by means of a return spring 22, which rests against the transport shuttle 1 upon one side thereof and against a guide sleeve 25 fixedly mounted upon the strip 16. In front of the stop surface of the guide sleeve 25, a buffer element 24 is disposed so as to serve as a shock absorber.

In FIG. 2, in addition to the nail transport device, the housing of the magazine 11, which is open upon one side thereof, can also be seen. It consists of a bottom 9, adjustable in height, which serves to guide the nail strips 5, the spring element 8, a cover 23 which can be tilted or pivoted away, as well as the guide strip 16 with its stop surface 2.

Within the guide strip 16, a longitudinal slit 26 for the lock claw 14 of the advance clamp 3 and an ascending curve or ramp 27 are provided, upon which the separated nail strip 5 is raised with its nail heads while it is moved forwardly, as is shown in FIGS. *3a–d*.

Several nail strips 5 are all pressed in the direction of the stop surface 2 of the nail transport device by means of the spring element 8, as can be seen in FIG. *1a*, so that when a first nail strip 5 is used up, the next one moves up against the stop surface 2. The transport shuttle 1 moves along the guide strip 16, due to the movement of the feed cylinder 6 or the return spring 22. If pressure from the pneumatic nail driving device is applied to the feed cylinder 6, the transport shuttle 1 first moves backward, which causes its nail strip separating element 12 to separate and slightly lift the nail strip 5 which is resting against the stop surface 2 from the remaining nail strips 5 within the magazine 11, as mentioned. The lock claw 14 of the advance clamp 3 is then pivoted around its axis of rotation 13 because it rests against the first nail strip 5 under the aforenoted spring action. As soon as the transport shuttle 1 has moved all the way back, the air pressure upon the feed cylinder 6 is released. The return spring 22 now biases the transport shuttle 1 in the feed direction. This causes the separated nail strip 5 to be clamped in between the nail strip separating element 12 and the lock claw 14 and to be moved forwardly in the feed direction by means of the transport shuttle 1, until the front nail 10 of the transported nail strip 5 enters the driving channel of the nail driving device through means of the entry slit.

The rigidly attached retainer device 4 with retainer claw 15, which functions according to the same principle as the advance clamp 3, ensures that the nail strip 5 remains at the advanced position when the transport shuttle 1 moves backwardly. The clamping force upon the nail strip 5 interposed between the nail strip separating element 12 and the lock claw 14 of the transport shuttle 1 is automatically released when the transport shuttle 1 moves backwardly, since the clamping point 20 in the feed direction is arranged in front of the axis of rotation 13 of the lock claw 14. A pressure spring 28 ensures that the nails 10 disposed at the end of the nail strip cannot enter the driving channel in an uncontrolled manner, but rather are maintained at their position within the entry slit until they are transported further in the direction of the driving channel by means of the next nail strip 5.

As soon as the first nail strip 5 has been used up, a second nail strip 5 is pressed against the stop surface 2 of the nail transport device by means of the spring element 8, separated and lifted from the remaining nail strips 5 by means of the nail strip separating element 12, and advanced in the feed direction in a manner analogous to the first nail strip 5.

Figure 4:
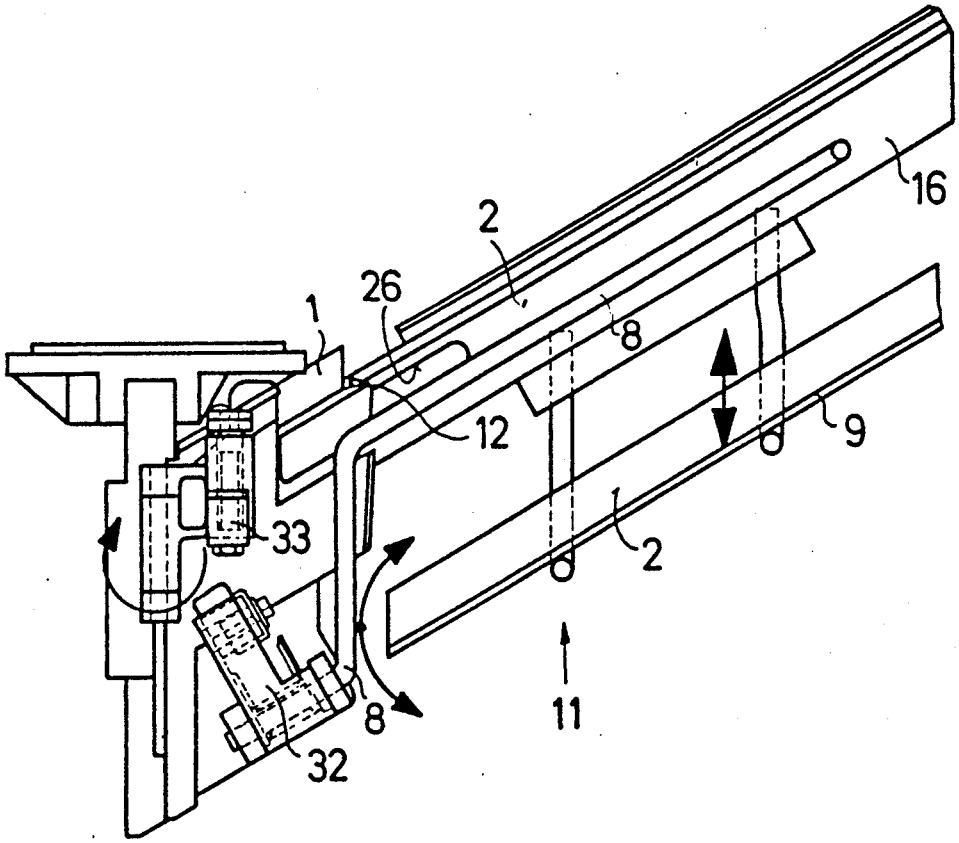
FIG. 4 is a side view of the nail driving device with a quick-release mechanism and handling stirrup.

The method of operation of the magazine 11 is best evident from FIG. 4. In order to load the magazine 11, the handling stirrup 32 is first released, which makes it possible to tilt the spring element 8 backwardly. Then as many nail strips 5 as desired, up to the maximum capacity of the magazine, can be loaded within the magazine. Subsequently, the handling stirrup 32 is again locked in position, which causes the spring element 8 to exert its spring biasing force upon the nail strips. The bottom 9 of the magazine 11 is attached to the magazine so as to be adjustable in height, and can therefore be adjusted to various lengths of the nails 10.

Both at the advance clamp 3 and at the retainer device 4, handle pieces 17 and 18 are provided; by means of which the clamping force upon the separated nail strip 5 can be manually released, if necessary. Furthermore, the nail strip separating element 12 can be tilted backwardly using a quick-release mechanism 33, in order to be able to remove nails 10 or nail strips 5 which might have become jammed within the entry slit of the nail transport device.

Obviously, many modifications and variations of the present invention are possible in light of the above teachings. It is therefore to be understood that within the scope of the appended claims, the present invention may be practiced otherwise than as specifically described herein.

We claim:

1. A nail driving device, comprising:

magazine means for housing a plurality of nails, said means being a box magazine for holding a plurality of nail strips next to each other;

means for biasing said plurality of nail strips toward one side of said magazine;

shuttle means disposed adjacent said one side of said magazine and movable in a first direction into said magazine for separating one of said plurality of nail strips from remaining ones of said plurality of nail strips within said magazine;

clamping means operatively cooperative with said shuttle means for clamping said separated one of said nail strips between said shuttle means and said clamping means such that said separated one of said nail strips can be moved in a second direction, opposite to said first direction, out of said magazine and toward a dispensing station at which said plurality of nails within said separated one of said nail strips can be serially dispensed; and means for moving said shuttle means and said clamping means in said second direction toward said dispensing station.

2. A nail driving device as set forth in claim 1, further comprising:

second means for moving said shuttle means and said clamping means in said first direction into said magazine.

3. A nail driving device as set forth in claim 2, wherein:

said second means for moving said shuttle means and said clamping means comprises a piston-cylinder assembly.

4. A nail driving device as set forth in claim 3, wherein:

said means for moving said shuttle means and said clamping means in said second direction comprises a return spring annularly surrounding a piston rod of said piston-cylinder assembly.

5. A nail driving device as set forth in claim 1, wherein:

said shuttle means has a wedge-shaped tip portion for interdisposition between adjacent nail strips so as to facilitate said separation of said one of said plurality of nail strips from said remaining ones of said plurality of nail strips.

6. A nail driving device as set forth in claim 1, wherein:

said clamping means comprises a lock claw pivotably mounted upon said shuttle means such that when said shuttle means is moved in said first direction into said magazine, the clamping force of said clamping means is reduced so as to permit said shuttle means and said clamping means to be moved relative to said separated one of said nail strips to a position at which said shuttle means and said clamping means can clampingly engage said separated one of said nail strips in order to feed said separated one of said nail strips toward said dispensing station, while when said shuttle is moved in said second direction out of said magazine, the clamping force of said clamping means is increased so as to permit said shuttle means and said clamping means to fixedly clampingly engage said separated one of said nail strips in order to feed said separated one of said nail strips toward said dispensing station.

7. A nail driving device as set forth in claim 1, wherein:

said biasing means comprises a spring element engaged with shank portions of said nails disposed within a nail strip disposed closest to a side of said magazine which is opposite said one side of said magazine.

8. A nail driving device as set forth in claim 6, further comprising:

biasing means for biasing said lock claw of said clamping means toward said separated one of said nail strips.

9. A nail driving device as set forth in claim 8, further comprising:

first handle means integrally formed upon said clamping means for manually pivoting said clamping means against said biasing means in order to remove said lock claw of said clamping means from its biased positional mode with respect to said separated one of said nail strips so as to rectify a jammed condition developed during movement of said shuttle means and said clamping means in either one of said first and second directions.

10. A nail driving device as set forth in claim 6, wherein:

said lock claw of said clamping means is pivotably mounted upon said shuttle means about an axis of rotation which is located rearwardly of a clamping point, defined between said lock claw of said clamping means and said separated one of said nail strips, as viewed in said second direction of movement of said shuttle means and said clamping means.

11. A nail driving device as set forth in claim 1, further comprising:

guide strip means disposed adjacent to said magazine for guiding said nails of said separated one of said nail strips as said nails of said separated one of said nail strips are moved toward said dispensing station.

12. A nail driving device as set forth in claim 11, further comprising:

longitudinal slit means defined within said guide strip means, and extending in a direction parallel to said first and second directions, for permitting said clamping means to extend therethrough in order to operatively cooperate with said shuttle means for clamping said separated one of said nail strips.

13. A nail driving device as set forth in claim 11, further comprising:

spring means disposed within the vicinity of a downstream end portion of said guide strip means, as viewed in said second direction of movement of said shuttle means and said clamping means toward said dispensing station, for resiliently engaging head portions of said nails in order to biasingly control movement of said nails along said guide strip means toward said dispensing station.

14. A nail driving device as set forth in claim 11, wherein:

said guide strip means comprises an ascending curved portion for uplifting said separated one of said nail strips from said remaining nail strips disposed within said magazine.

15. A nail driving device as set forth in claim 11, wherein:

said guide strip means comprises guide edge means for guidingly supporting head portions of said nails as said separated one of said nail strips is moved along said guide strip means in said second direction toward said dispensing station.

16. A nail driving device as set forth in claim 11, further comprising:

a retaining claw pivotably mounted upon said guide strip means such that when said shuttle means and said clamping means are moved in said second direction out of said magazine, the retaining force of said retaining claw is reduced so as to permit said shuttle means and said clamping means to move said separated one of said nail strips toward said dispensing station so as to serially dispense said nails within said separated one of said nail strips, while if said separated one of said nail strips should experience retrograde movement in said first direction back into said magazine, the retaining force of said retaining claw is increased so as to clampingly engage said separated one of said nail strips and thereby prevent further retrograde movement of said separated one of said nail strips in said first direction back into said magazine.

17. A nail driving device as set forth in claim 16, wherein:

said retaining claw of said guide strip means is pivotably mounted upon said guide strip means about an axis of rotation which is located rearwardly of a clamping point, defined between said retaining claw and said separated one of said nail strips, as viewed in said second direction of movement of said shuttle means and said clamping means.

18. A nail driving device as set forth in claim 16, further comprising:

biasing means for biasing said retaining claw of said guide strip means toward said separated one of said nail strips.

19. A nail driving device as set forth in claim 18, further comprising:

second handle means integrally formed upon said retaining claw for manually pivoting said retaining claw against said biasing means in order to remove said retaining claw from its biased positional mode with respect to said separated one of said nail strips so as to rectify a jammed condition developed during movement of said separated one of said nail strips in either one of said first and second directions.

20. A nail driving device as set forth in claim 1, wherein:

said box magazine comprises a bottom wall which is vertically adjustable with respect to said magazine so as to accommodate nails of different lengths.

* * * * *